United States Patent [19]

Menzi

[11] Patent Number: 4,482,287

[45] Date of Patent: Nov. 13, 1984

[54] EXCAVATOR

[75] Inventor: Ernst Menzi, Widnau, Switzerland

[73] Assignee: Ernst Menzi AG, Widnau, Switzerland

[21] Appl. No.: 373,661

[22] Filed: Apr. 30, 1982

[30] Foreign Application Priority Data

May 15, 1981 [AT] Austria ..... 2173/81
Dec. 4, 1981 [AT] Austria ..... 5215/81

[51] Int. Cl.[3] ..... E02F 9/08

[52] U.S. Cl. ..... 414/694; 212/189; 180/132; 180/211; 414/687; 280/767; 280/764.1

[58] Field of Search ..... 414/685, 694, 687; 212/189; 180/24.02, 41, 209, 211, 212, 8 BA, 764, 767, 132, 136, 138, 144; 37/117.8, 117.5

[56] References Cited

U.S. PATENT DOCUMENTS 3,112,594 12/1963 Hallenbeck ..... 180/211 X
3,235,280 2/1966 Moustgaard ..... 414/694 X
3,490,629 1/1970 Menzi ..... 414/694
3,499,559 3/1970 Pedersen ..... 414/694
3,635,364 1/1972 Tingleff ..... 414/694
4,084,395 4/1978 Nannen ..... 180/211 X
4,360,311 11/1982 Dufour ..... 414/687

FOREIGN PATENT DOCUMENTS 1050078 1/1954 France ..... 414/694

*Primary Examiner*—Robert J. Spar
*Assistant Examiner*—Terrance L. Siemens
*Attorney, Agent, or Firm*—Toren, McGeady and Stanger

[57] ABSTRACT

An excavator can be moved in a step-like manner employing its boom and stepping feet or it can be arranged for conventional driven wheeled movement. The excavator includes a supporting frame with outwardly extending supporting arms on which first wheels and/or stepping feet can be mounted. A superstructure is positioned on the supporting frame and the boom is articulated to the superstructure. A second wheel is supported on the superstructure and can be moved in the vertical direction between an active position resting on the ground on which the excavator is supported and an inactive position spaced upwardly from the ground. With two first wheels on one side of the supporting frame and the second wheel in the active position on the opposite side, conventional three-wheel driven movement can be achieved with the second wheel effecting the steering of the excavator.

7 Claims, 8 Drawing Figures

EXCAVATOR

SUMMARY OF THE INVENTION

The present invention is directed to an excavator including a supporting frame with a pair of supporting arms on each of two opposite sides of the frame. Supporting wheels and/or supporting feet can be secured to the supporting arms. A superstructure rotatable about an approximately vertical axis is mounted on the supporting frame. A boom capable of carrying digging, cutting or other working tools is positioned on the superstructure.

Excavating machines of this type, note Austrian Pat. No. 305,910, are very mobile and can be operated over the most difficult terrain, because, for forward movement of the machine, the front end of the supporting frame is lifted during operation by placing the digging tool on the ground and moving the machine forwardly or backwardly by manipulating the boom or it can be steered by rotating the superstructure. In the movement operations, the supporting feet are lifted off the ground and when such operations are completed the supporting feet are lowered onto the ground. By repeating these movement operations, the excavating machine can be moved in a stepwise manner. For adapting the machine to uneven terrain, it is known to support each of the supporting arms individually and independently of one another so that they can be pivoted in a vertical plane. In such equipment, however, only so-called stepping movement is possible.

For transporting such excavating equipment to a construction site or from one work place to another, it is necessary to move the excavator as a trailer vehicle. If stepping movement over a paved street or other supporting surface is carried out, there is the likelihood of damage to the supporting surface by the digging tool on the boom and, moreover, the speed of movement is quite slow.

There is one example of such equipment, shown in German Pat. No. 28 07 517, in which both stepping movement and conventional driving movement is attempted. In this device, both supporting feet and wheels are provided at the outer or free ends of the supporting arms. Depending on the type of movement to be effected, either the wheels or the feet are lowered onto the ground. During excavation, the supporting feet are used and the wheels are lifted from the ground, however, when the device is to be moved to another location or another construction site, the wheels are lowered and the supporting feet lifted.

In such an embodiment, it is necessary to provide some manner of steering the wheels at the free ends of the supporting arms and, further, with both the wheels and supporting feet located at the free ends of the supporting arms a space problem is presented.

Therefore, it is the primary object of the present invention to provide an excavating machine which can perform stepping movement as well as conventional wheeled driving movement without locating wheels on all of the four supporting arms and where steering can be accomplished in a simple manner.

In accordance with the present invention, a vertically adjustable wheel is mounted on the superstructure and at least one of the wheels in the superstructure or on the supporting arms is driven.

With such an arrangement, it is possible to provide a simple machine construction which affords a quick changeover between stepping movement and wheeled driving movement. The wheel located on the superstructure can be arranged for ease in vertical adjustment so that steering during wheeled driving movement requires no additional parts, because such steering can be performed in a simple manner by rotating the superstructure about its approximately vertical axis.

An advantageous feature of the present invention concerns the space requirement of the excavating device, because it is unnecessary to provide wheels on one pair of the supporting arms. The supporting feet located on the free ends of the supporting arms can be constructed as necessary, since there is no additional space needed for the installation of the wheels. Another desirable feature of the excavating machine is that its use over difficult steep terrain requires narrow supporting arms without any laterally protecting parts. The machine operator can change over quickly and without any difficulty from a stepping operation to a wheeled driving operation. Another important feature is that the wheel can be located on the superstructure so that it does not hinder the vision of the machine operator or interfere with the machine's mobility.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
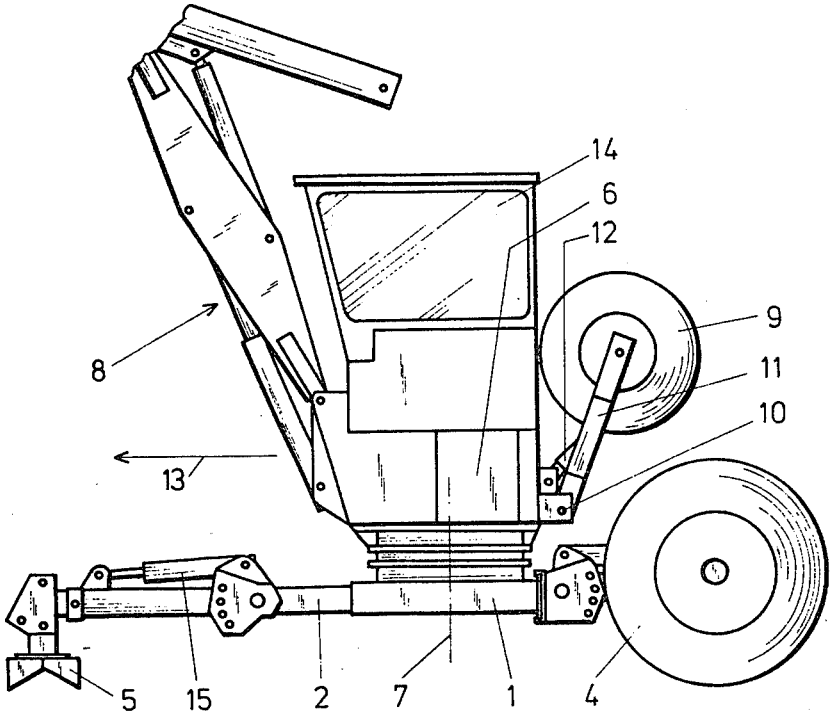
FIG. 1 is a side elevational view of an excavating machine embodying the present invention and illustrated in the working position.

In FIGS. 1–5 an excavating machine is illustrated including a supporting frame 1 extending generally horizontally with a pair of supporting arms 2,3 on each of two opposite sides of the supporting frame. The opposite sides refers to the sides extending in the direction of movement shown by arrow 13 in the drawing. A wheel 4 is secured to the outer or free end of each supporting arm 3 while a supporting foot 5 is mounted on the outer or free end of each of the supporting arms 2. An upwardly extending support structure 6 is mounted on the supporting frame 1 and is rotatable about an approximately vertical axis 7 relative to the supporting frame. A boom 8 is articulated to one side of the superstructure 6, only a portion of the boom is shown in the drawing. At its free end, that is the end spaced outwardly from the superstructure, the boom supports a digging, cutting or other working tool. The movement of the boom and of the working tool is effected by hydraulic cylinders.

A vertically movable wheel 9 is supported on the superstructure 6. Wheel 9 is located on the opposite side of the superstructure 6 from the boom 8 and is held at the outer or free end of an arm 11 pivotally mounted about a horizontal axis 10 on the superstructure. Arm 11 is pivotally displaced relative to the superstructure 6 by a hydraulic cylinder 12.

One or both of the wheels 4 on the supporting arms 3 can be equipped with a hydraulic drive so that the wheel is driven.

Figure 2:
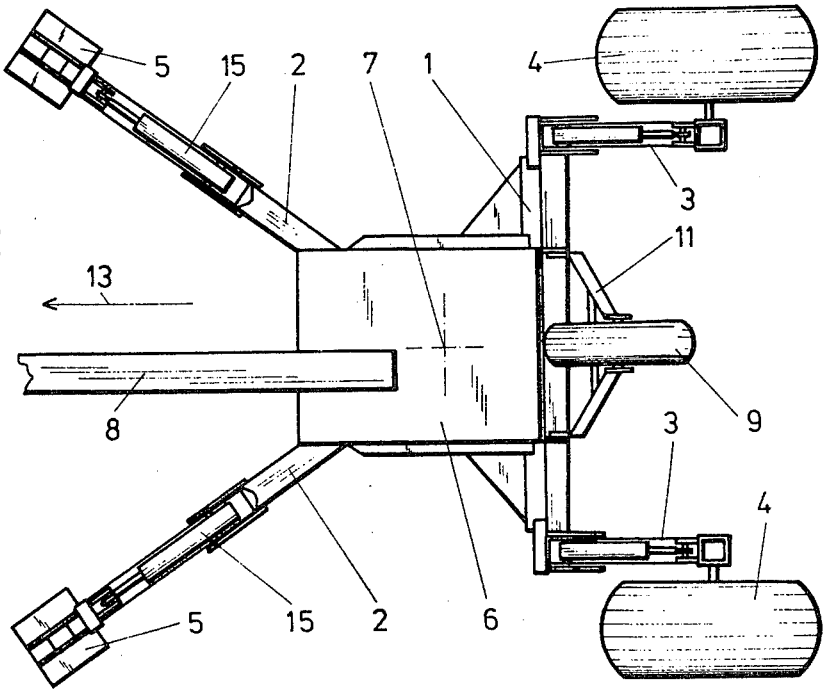
FIG. 2 is a top view of the machine shown in FIG. 1.

During working operations, the excavating machine is in the position shown in FIGS. 1 and 2, that is, the digging or other work operation is carried out with the boom 8 located between the two supporting arms 2. The supporting arms 3 with their wheels 4 are disposed on the opposite side of the machine from the boom 8. During forward stepping movement of the machine, the working tool, located at the outer or free end of the boom 8, is supported on the ground and by lifting and bending the boom 8, the supporting arms are lifted off the ground and the machine pulls itself forwardly in the direction of the arrow 13. After the boom is lifted from contact with the ground, the supporting feet 5 on the arms 2 are again lowered into contact with the ground. The working operation can then be continued at the new location to which the machine has been moved. Wheel 9 on the superstructure 6 is located at the rear of the operator's cab 14 and as a result does not interfere with the excavating or other working operation carried out by the machine.

Figure 3:
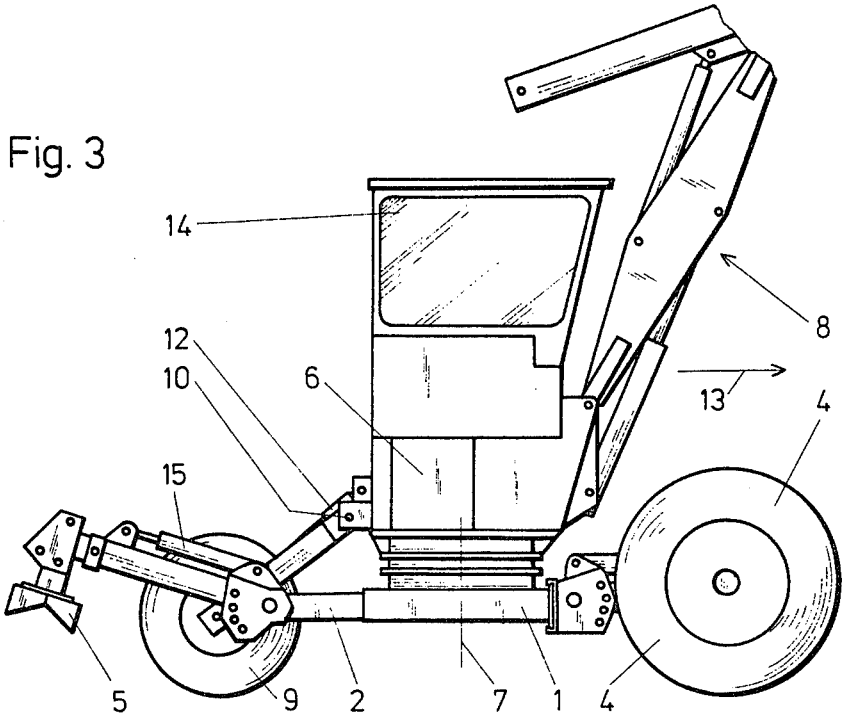
FIG. 3 is a view similar to FIG. 1, however, illustating the machine ready for wheeled driving movement.
Figure 4:
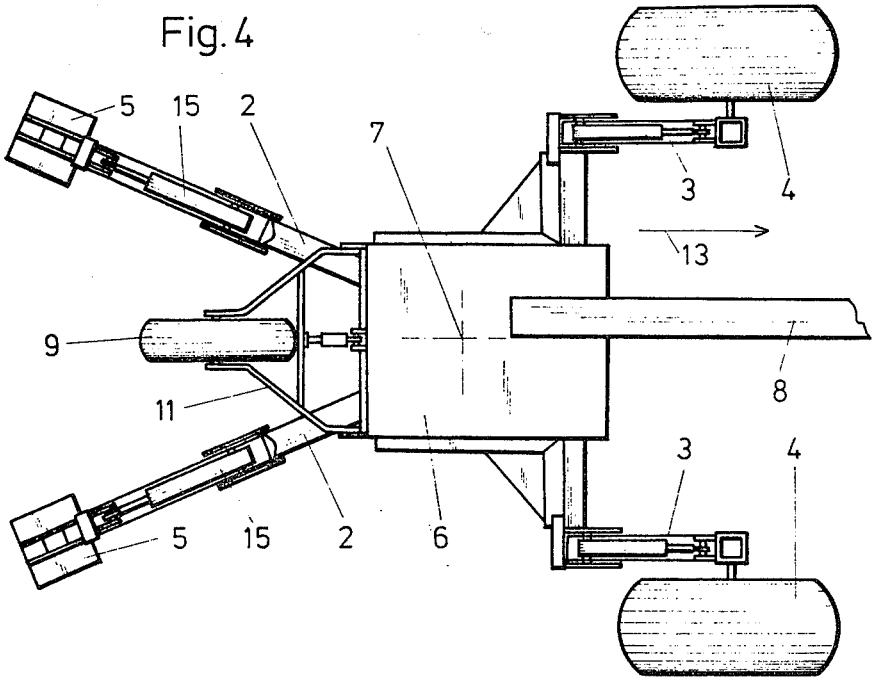
FIG. 4 is a top view of the machine shown in FIG. 3.
Figure 5:
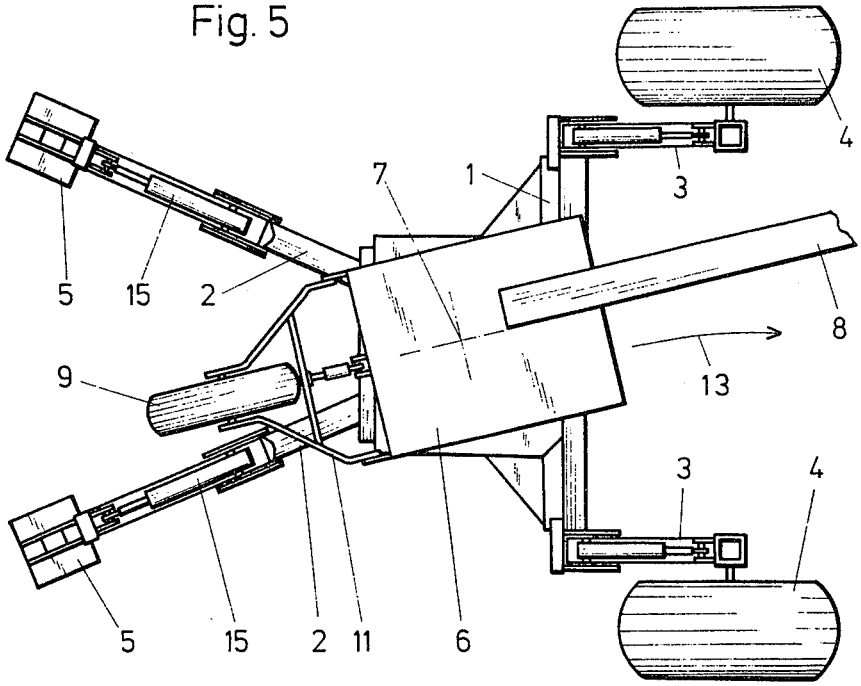
FIG. 5 is a top view of the machine similar to that shown in FIG. 4, and illustrating the steering operation.

If the excavating machine is to be moved for a considerable distance, then it is simple to change over to wheeled driving operation initially by rotating the superstructure 6 about vertical axis 7 through approximately 180° so that with the supporting frame 1 and the supporting arms 2 and 3 in the same position, the boom location is reversed and points in the opposite direction to that shown in FIGS. 1 and 2, note FIGS. 3–5. Wheel 9 can be pivoted downwardly by the hydraulic cylinder 12 until it is supported on the ground. When the wheel is pressed down against the ground, the supporting arms 2 and their supporting feet 5 are raised upwardly off the ground. It would also be possible to lift the supporting feet by means of the hydraulic cylinders 15 on the supporting arms.

In this position, the wheel 9 has been displaced from its inactive position to its active position and a three-wheel vehicle is provided having relatively good stability due to the large wheel base. Since the spacing between the wheels 4 is relatively large, though there is only one wheel 9 on the opposite side of the machine from the wheels 2, no tilting movements occur. By utilizing an appropriate drive for the wheels 4, the excavating machine can now be moved as desired and steering can be effected in a simple manner by rotating the superstructure 6 about its vertical axis 7. Such a rotary steering adjustment is illustrated in FIG. 5 where the wheel 9 is turned relative to the wheels 4.

After moving the excavating machine to a new work site, only the wheel 9 has to be lifted upwardly by the arm 11 into its inactive position, and subsequently the boom, after the superstructure 6 is rotated through 180°, is again ready for use. Consequently, very few working operations need to be performed and all of these operations can be effected in a simple manner from the operator's cab 14 by means of hydraulic cylinders.

Figure 6:
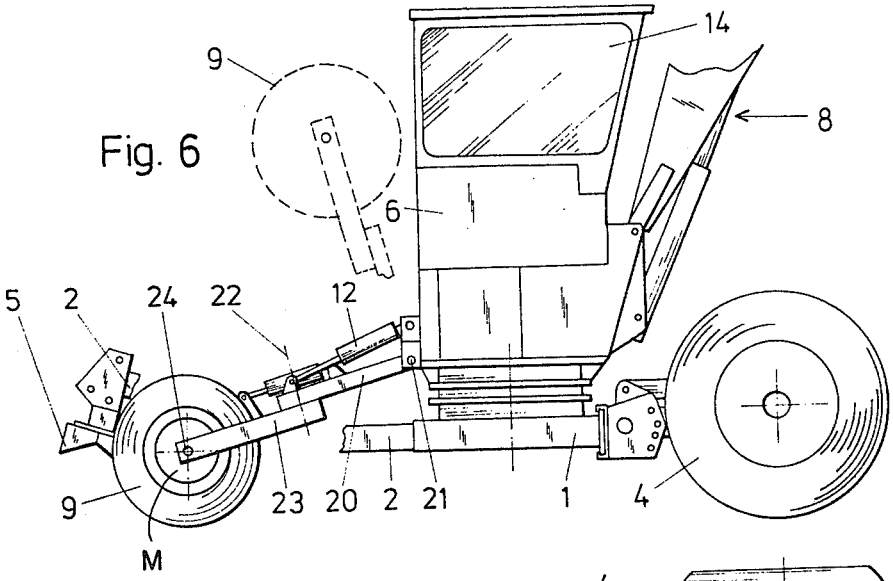
FIG. 6 is a side elevational view of another embodiment of the present invention with the machine shown in the wheeled driving position.
Figure 7:
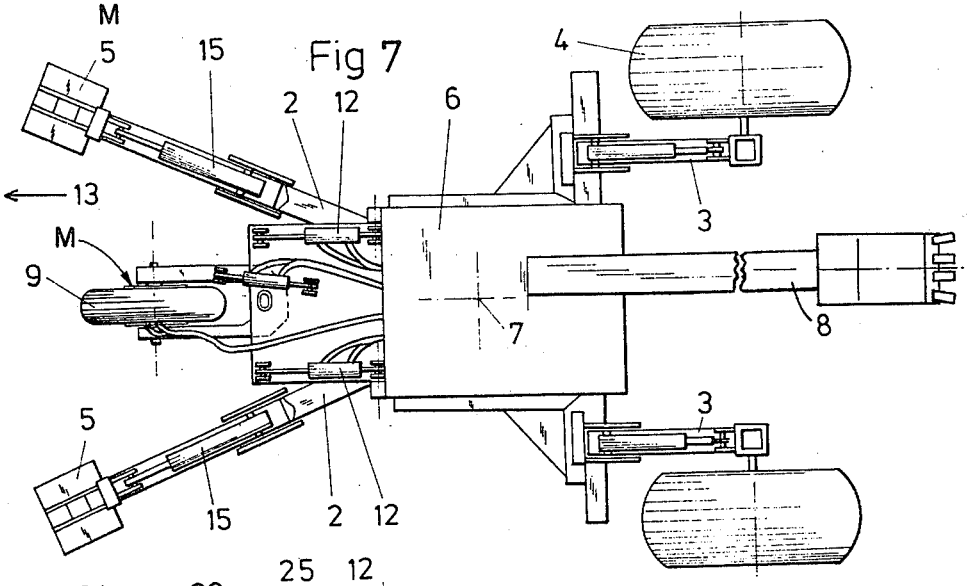
FIG. 7 is a top view of the machine shown in FIG. 6.
Figure 8:
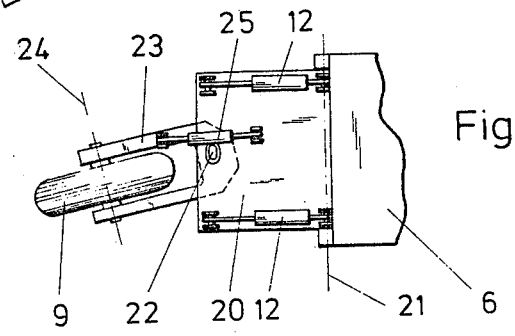
FIG. 8 is a partial top view of the machine shown in FIG. 7 including a vertically adjustable supporting member on the superstructure and illustrating the wheel being steered.

In the embodiment illustrated in FIGS. 6 to 8, the wheel 9 is located on the opposite side of the superstructure 6 from the boom 8. A supporting member 20 is pivotally connected to the superstructure 6 so that it can be swung about a horizontal axis 21. The supporting member 20 can be pivoted through a vertical arc downwardly into a driving position or active position and if moved upwardly it is located in the inactive position with the movement being effected by hydraulic cylinders 12. Wheel 9 is mounted in an approximately U-shaped supporting arm 23 and the supporting arm 23 is pivotally mounted on the supporting member 20 for movement generally horizontally about an upwardly extending axis 22. The axis 22 is located in an approximately vertical plane and is approximately vertical in the driving position shown in FIG. 6. As can be noted in FIG. 6, the angle of the axis 22 relative to the vertical depends on the angle of adjustment of the supporting member 20. By rotating the supporting arm about the axis 22, the wheel can be turned for obtaining a maximum steering angle. Though wheels 4 and 9 are shown as having different dimensions, they may be of the same size, that is, diameter and width.

In this second embodiment, the swivel axis 22 between the supporting arm 23 and the supporting member 20 is spaced horizontally from the axis of rotation 24 of the wheel 9 as viewed in the active position of the wheel shown in FIGS. 6 to 8. It would also be possible, within the scope of the invention, to position the wheel directly under the supporting member 20 so that its supporting arm is arranged approximately vertical whereby the axes 22 and 24 are located in the same plane and intersect. In such an embodiment an appropriate steering movement can be performed in a simple manner.

To steer the excavating machine, a hydraulic cylinder 25 is connected to one side of the U-shaped supporting arm 23 so that, when the hydraulic cylinder piston is moved in or out, the supporting arm 23 is pivoted about the axis 22. The greater the spacing of the points of attachment of the hydraulic cylinder to the supporting member 20 and the supporting arm 23 from the axis 22, the less force is required for the steering movement. If hydraulic cylinder 25 is engaged at the supporting arm 23 by a short lever arm relative to the axis 22, then the pivotal adjustment of the supporting arm in relation to the movement of the hydraulic cylinder is greater, however, correspondingly greater forces are then required.

In the drawing, supporting member 20 is illustrated as a solid plate, however, different structural arrangements of the member can be used. It would be possible to employ a frame construction for the supporting member. In an appropriate arrangement, in place of the two hydraulic cylinders 12 which pivotally displace the supporting member 20, a single hydraulic cylinder 12 could be used. Further, a different construction of the supporting arm 23 could be used. It would be possible to employ an L-shaped supporting arm 23 so that the wheel could be secured in a cantilevered manner at one side of the supporting arm 23.

During excavation or other work, the machine is in a position where the boom is located between the two supporting arms 2, that is in a position turned through 180° from the position illustrated in FIGS. 6 and 7. If the excavating machine is to be moved by a greater distance than is convenient by stepping movement, then the machine can be switched over to wheeled driving operation by first rotating the superstructure 6 about the vertical axis 7 through approximately 180° so that with the supporting frame 1 and supporting arms 2 and 3 remaining in the same position, the boom is turned so that it is oriented as shown in FIGS. 6 and 7. Next, the wheel 9 mounted on the supporting member 20 can be pivoted downwardly by means of the hydraulic cylinders 12 until the wheel 9 is supported on the ground. By pressing the wheel 9 downwardly, the supporting arms 2 and with them the supporting feet are lifted off the ground. It is possible, of course, to lift the supporting feet by means of the hydraulic cylinders 15.

If the machine is to be driven around small radius curves greater steering movement can be achieved by pivoting the wheel 9 relative to the supporting member 20. Therefore, steering can be effected by only pivoting the supporting arm 23 at the supporting member 20, or by rotating the superstructure 6, or by the combination of the two steering operations.

In the embodiment disclosed in FIGS. 6 to 8, independently of the distance of the supporting arms which carry supporting feet or wheels, steering can be performed in addition to or separately from the steering movement provided by rotating the superstructure, so that in a simple manner the machine can be moved through small radius curves. Such an arrangement affords an additional improvement over the embodiment in FIGS. 1 to 5 without any considerable structural expenditures.

It is also advantageous in movement through narrow passages that the superstructure remain aligned with the long direction of the machine, that is, in a position where only the wheel is pivoted with respect to the vertically movable supporting member.

Instead of a movably displaceable pivot arm 11 or a supporting member 20, there are other ways in which the wheel can be moved vertically. It would be possible, for instance, to provide vertical guide rails on which an appropriate wheel carrier, such as the supporting arm 11 or the supporting member 20, is movable. It would be possible to locate such a wheel 9 next to the operator's cab 14 at the lateral regions of the superstructure 6 where these wheels could be lowered as required.

It is within the scope of the invention that the wheel 9 could be driven so that only wheel 9 is driven and the wheels 4 are not, note FIGS. 6 and 7 where a hub motor drives wheel 9. In accordance with the present invention, it would be possible to utilize an excavating machine in which the supporting arms 3 mount both supporting feet and wheels. When the wheels are lowered for driving movement, the supporting feet are released. For a proper driving movement, it is necessary to employ at least three wheels.

In accordance with the present invention, an excavating machine, which can be moved in a stepped manner, can be converted in a simple way so that it performs as a mobile machine, that is, it can perform conventional wheeled driving movement.

While specific embodiments of the invention have been shown and described in detail to illustrate the application of the inventive principles, it will be understood that the invention may be embodied otherwise without departing from such principles.

I claim:

1. An excavating machine comprising a generally horizontally arranged supporting frame having a pair of supporting arms on opposite sides of said frame, each of said supporting arms extending outwardly from said supporting frame, at least one of a first wheel and a supporting foot secured to each of said supporting arms, a superstructure rotatably mounted on and extending upwardly from said supporting frame for rotation about a generally vertically arranged axis, a boom supported on said superstructure, said boom arranged to have a working tool positioned at its end outwardly from said superstructure, wherein the improvement comprises a second wheel mounted on said superstructure and movably displaceable in the vertical direction relative to said superstructure, at least one of said first and second wheels arranged to be driven, a supporting member vertically movably mounted on said superstructure for movement about a horizontal axis, said second wheel is pivotally mounted on said supporting member for pivotal movement about an axis located approximately vertically when said second wheel is in position for effecting wheeled driving movement of said machine so that by moving said supporting member about the horizontal axis said second wheel can be selectively placed in contact with the ground or moved vertically upwardly from the ground, and means for pivoting said second wheel about the approximately vertical axis for steering the excavating machine when said second wheel is in contact with the ground.

2. An excavating machine, as set forth in claim 1, wherein said second wheel is located on the opposite side of said superstructure from said boom.

3. An excavating machine, as set forth in claim 1, wherein an approximately U-shaped supporting arm supports said second wheel and said supporting arm is pivotally connected to said supporting member for movement about the vertical axis.

4. An excavating machine, as set forth in claim 3, wherein the vertical pivot axis between said supporting arm and said supporting member and the axis of rotation of said second wheel in the active position of said second wheel for wheeled driving movement of said machine are spaced apart in the horizontal direction.

5. An excavating machine, as set forth in claim 4, wherein said means for pivoting said second wheel comprises a hydraulic cylinder secured to said supporting member and to said supporting arm at a position spaced laterally from the vertical pivot axis on said second wheel relative to said supporting member.

6. An excavating machine, as set forth in claim 3, wherein the vertical pivot axis of said second wheel relative to said supporting member and the axis of rotation of said second wheel in the active position are arranged in a common generally vertically extending plane.

7. An excavating machine, as set forth in claim 6, wherein said means for pivoting said second wheel comprises a hydraulic cylinder secured to said supporting member and to said supporting arm at a position spaced laterally from the vertical pivot axis of said second wheel relative to said supporting member.

* * * * *